US007305786B2

(12) United States Patent
McGarry

(10) Patent No.: US 7,305,786 B2
(45) Date of Patent: Dec. 11, 2007

(54) PISTOL WITH LOADED CHAMBER INDICATOR

(75) Inventor: James McGarry, Prescott Valley, AZ (US)

(73) Assignee: Sturm, Ruger & Company, Inc., Southport, CT (US)

( * ) Notice: Subject to any disclaimer, the term of this patent is extended or adjusted under 35 U.S.C. 154(b) by 327 days.

(21) Appl. No.: 10/825,517

(22) Filed: Apr. 15, 2004

(65) Prior Publication Data

US 2005/0229457 A1 Oct. 20, 2005

(51) Int. Cl.
*F41A 9/53* (2006.01)

(52) U.S. Cl. ..... 42/1.05; 42/25; 42/46

(58) Field of Classification Search ..... 42/1.05, 42/1.01, 25, 46

See application file for complete search history.

(56) References Cited

U.S. PATENT DOCUMENTS

| | | | | | |
|---|---|---|---|---|---|
| 790,634 | A | * | 5/1905 | Hirsh | 42/136 |
| 808,463 | A | * | 12/1905 | Luger | 42/16 |
| 891,438 | A | | 6/1908 | Peard | |
| 1,028,032 | A | * | 5/1912 | Krag | 89/140 |
| 1,082,969 | A | | 12/1913 | Nelson | |
| 1,459,284 | A | | 6/1923 | Declaye | |
| 1,896,820 | A | * | 2/1933 | Jolidon | 89/148 |
| 2,100,273 | A | * | 11/1937 | Skandera | 42/1.05 |
| 2,145,328 | A | * | 1/1939 | Walther | 42/16 |
| 4,100,691 | A | | 7/1978 | Wicklund | |
| 4,726,136 | A | | 2/1988 | Dornaus et al. | |
| 5,142,805 | A | | 9/1992 | Horne et al. | 42/1.02 |

(Continued)

FOREIGN PATENT DOCUMENTS

DE 209101 4/1909

(Continued)

OTHER PUBLICATIONS

Luger, Smith, Small Arms of The World: A Basic Manue of Military Small Arms, Military Service Publishing Co. PA, 1943 (pp. 113-117).*

(Continued)

*Primary Examiner*—Michelle Clement
(74) *Attorney, Agent, or Firm*—Duane Morris, LLP

(57) ABSTRACT

A centerfire autoloading pistol including a loaded chamber indicator to identify the presence of a cartridge loaded in the firing chamber. The pistol may generally include a housing having an external surface and defining a chamber to receive a cartridge, a barrel unit disposed at least partially in the housing, and an indicating element having two ends. In one embodiment, the indicating element may be pivotally mounted to the housing proximate to one of the ends. The indicating element is displaceable in response to contact by the cartridge from a first position which may in one embodiment correspond to an absence of a cartridge loaded in the chamber, to a second position which may in one embodiment correspond to a presence of a cartridge loaded in the chamber. A biasing member, such as a spring, may be provided for biasing the indicating element towards the first position. In one embodiment, the indicating element protrudes outwards from the external surface of the pistol in response to contact by the cartridge to provide visual and tactile indication of a loaded chamber condition to a user of the pistol. Initial which may include alphanumeric characters, symbols, colors, or a combination thereof may be provided on the indicating element.

9 Claims, 8 Drawing Sheets

U.S. PATENT DOCUMENTS

| | | | | |
|---|---|---|---|---|
| 5,410,831 | A * | 5/1995 | Felk | 42/25 |
| 6,161,322 | A | 12/2000 | Liebenberg | 42/1.04 |
| 6,256,915 | B1 | 7/2001 | da Silveira | 42/1.05 |
| 6,257,116 | B1 * | 7/2001 | Moczijdlower et al. | 89/155 |
| 6,493,977 | B1 | 12/2002 | Liebenberg et al. | 42/1.05 |
| 6,857,213 | B2 | 2/2005 | Fluhr | 42/1.05 |
| 6,966,137 | B2 * | 11/2005 | Gussalli Beretta | 42/46 |
| 2002/0194761 | A1 | 12/2002 | Liebenberg et al. | 42/1.05 |
| 2005/0229458 | A1 * | 10/2005 | McGarry | 42/1.05 |

FOREIGN PATENT DOCUMENTS

WO WO 03/046465 6/2003

OTHER PUBLICATIONS

American Rifleman, "The Post Modern Pistol", Mar. 2002, pp. 57,37-39; 74.
Antaris, Leonard, "Star Firearms", 2002.
Combat Handguns, May 2001, cover page and "New Mauser M2 .45CP," by Walt Rauch, pp. 10-12 (top photo and last paragraph p. 11), p. 74 (third paragraph).
Gun World, "Gun Test: Erma's Luger Look-Alike," by Roger Combs, Sep. 1990, pp. 80-81 (first column, 4th paragraph p. 81).
American Rifleman, "Zastava CZ99 Pistol," Feb. 1991, cover page and, pp. 50-51.
American Rifleman, Unidentified article, Jul. 2001, p. 73.
American Rifleman, "Mauser M2 Pistol", Mar. 2000, p. 58.
American Rifleman, "Dope Bag, CZ 100 Pistol" Sep. 1998, p. 44.
Handguns, "Surplus Scene", by R. Shimek, Feb. 1995, pp. 30-31.
147-4 & U.S. National Archives, J.P. Sauer & Sohn, Suhl, "Expert Opinion", May 19, 1934, p. 2.
Guns, "Brownings 10/70-The Last Hammerless Midframe", May 1975, p. 67-68.
Guns Illustrated, "Marlin Model 9 Carbine", 1987, pp. 71, 73.
American Rifleman, "Astra A-80 Pistol," Sep. 1981, pp. 60-61.
Ten Shots Quick, "Savage .32 Caliber Automatic Pistol", 1914 catalog excerpt, p. 58.
Handguns, "Mauser", Apr. 2001, p. 34.
Handguns for Sport & Defense, "New! All American Stainless 'Luger'", Nov. 1992, p. 52.
American Rifleman, "Mitchell Arms Pistol Parabellum P. 08," Jan. 1994, p. 37.
Guns & Ammo, Advertisement, Mitchell Arms, Dec. 1992, p. 39.
Guns&Ammo, " . . . Popularized Walther's_years of Authentic Reliability Make the PPK a Legend", Feb. 1970, p. 25.
Guns&Ammo, "Strictly Handguns", Oct. 1994, pp. 36 & 119.
American Gunsmith, "Troubleshooting", Oct. 1997, p. 16-17.
American Gunsmith, "Solving Problems with Pocket-Size 'Carry Gun'," Jul. 2000, p. 8.
Guns& Ammo, advertisement-Walther P-38, p. 29, Nov. 2001.
Handguns, "Firing Line Report, Walther P22", May 2002, p. 52.
Gun Tests, "Walther PPK", Nov. 2002 p. 5.
Gun Tests, "Smith & Wesson", Apr. 2003, p. 8.
American Rifleman, "Product Reviews, Taurus Millenium" Oct. 1997, p. 14.
Handguns, article by D. Pridgen, 2002, p. 17.
American Rifleman, "Dope Bag Data & Comment, Taurus Millennium" Jul. 2001, pp. 72-73.
Guns&Ammo, "Proof House", Mar. 1991, p. 78.
S.W.A.T., "Best .380 Autos", Dec. 1990, p. 46.
Guns, Unidentified article, May 1991, p. 37.
American Rifleman, "Dope Bag Data & Comment," Jul. 1999, p. 49.
Gun World, Unidentified article, Nov. 1998, p. 85, top photo.
American Rifleman, "Product Previews, HS 2000 Pistol," Jun. 2000, p. 14.
American Rifleman, "Colt's Model 1907," Feb. 1997, p. 58-59.
Guns, "Highlanders", Apr. 1999, p. 74.
Handguns, "Kimber Tactical Custom II", Jun./Jul. 2003, p. 40.
Complete Book of Autopistols, "New Kimber LTP II .45ACP", 2003, pp. 23-24.
Handguns, "Llama", Dec. 1998, p. 74.
Handguns, Unidentified article, 1993, p. 76.
Performance Shooter, "Pistol Comparison", Feb. 1996, p. 6.
Shooting Times, Unidentified article, Nov. 1992, p. 71.
Guns, Advertisement, "Beretta" Mar. 1998, p. 95, 96.
Handguns, Unidentified article, Sep. 2001, p. 53.
Guns&Ammo, Unidentified article, Jan. 1996, p. 53.
Guns Rifle Annual, Colt-Sauer, 1975, p. 12.
Gun Test, "Pistols", Feb. 2003, p. 6.
Handguns, "FN's Double Action", 1996, p. 204.
The New Gun Week, "FN Forty-Nine Pistol Fed All Commercial 9mm Ammo", Sep. 1, 2002, p. 6.
Shooting Times, Unidentified article re Steyr M40, Aug. 2001, p. 61.
Modern Beretta Firearms, pp. 55-56, 64, 1994.
Gangarosa, G., "The Walther Handgun Story", 1999, pp. 22-23.
Gangarosa, G., The Walther Handgun Story, 1999, p. 40.
Gangarosa, G., "The Walther Handgun Story", 1999, p. 87.
Gangarosa, G., "The Walther Handgun Story", 1999, p. 80.
Gangarosa, G., "The Walther Handgun Story", 1999, p. 127.
Gangarosa, G., "The Walther Handgun Story," 1999, p. 130.
Gangarosa, G., "The Walther Handgun Story", 1999, p. 174.
Gangarosa, G., "The Walther Handgun Story", 1999 p. 274.
Antaris, Leonardo, "Star Firearms", 2002, p. 512, 515.
Antaris, Leonardo, "Star Firearms", 2002, p. 294.
Antaris, Leonardo, "Star Firearms", 2002, p. 532.
Antaris, Leonardo, "Star Firearms", 2002, p. 457.
Antaris, Leonardo, "Star Firearms", 2002, p. 530.
Shooting Times, Unidentified article, Jul. 1999, p. 63, left column.
Handguns, Unidentified article, May 2001, p. 67, center photo.
Woman&Guns, Unidentified article, Mar./Apr. 2002, p. 34.
Excerpt from "The American Rifleman Magazine", "Sauer Model 1930 Pistol", by E.J. Huffschmidt, Sep. 1965, p. 40, reprinted in unknown source, p. 192.
Guns, "Stevenson: What's A Safety?", paragraph 7, Jan. 1974.
Unidentified article re HK P9M8, Feb. 1997, p. 27, left column, 2nd full paragraph (source unknown).
Ten Quick Shots, "High Tide for the Model 1907", pp. 53-55, publication date unknown.
Ten Quick Shots, "The Very Scarce Blued Indicator", p. 140-141, publication date unknown.
Ten Shoots Quick, "Experimentals and Oddities", cover page & p. 136, publication date unknown.
Advertisement, "The New XD Pistol from Springfield Armory", source and publication date unknown.
Combat Handguns, New Springfield XD40 .40 S&W, p. 22, publication date unknown.
Advertisement, "X-Treme Duty, Springfield Armory USA", source and publication date unknown.
Guns&Weapons for Law Enforcement, "Gun Test, H&K USP45 Tactical", pp. 44-45, publication date unknown.
Fifth Addition, This .45 ACP Is A Familiar Clone, But Impressed This Shooter, p. 115, publication date unknown.
American Rifleman, "Dope Bag Data & Comment,", publication date unknown.
Astra Automatic Pistols, Model 800 (Condor), pp. 128-131, source and publication date unknown.
Pistols, Astra A-80 and Llama Model IX, p. 66, source and publication date unknown.
Astra Automatic Pistols, Model 4000 (Falcon): Features, p. 192, source and publication date unknown.
Astra Automatic Pistols, "Model A-80: Features", p. 232, source and publication date unknown.
Astra Automatic Pistols, "Special Safety Device of the ASTRA", p. 48, source and publication date uknown.
Astra Model 200 (Firecat), "Historical Perspective", p. 43, 47, source and publication date unknown.
The Earliest Astra Features, "Features", p. 21, source and publication date unknown.
The Gun Digest Book of 9mm Handguns, "Mitchell Arms Luger", p. 17, publication date unknown.
Handguns, 94 p. 146, source and publication date unknown.
The P38: The First Fifty Years, "The Characteristics of the P 38", pp. 45-46, publication date unknown.

Pistols, 9 mm Walter P38, p. 40, first paragraph, source and publication date unknown.
Unidentified article, "9mm Parabellum Model 1904," Germany (pre-1945), source and publication date unknown.
Unidentified article, "Walther 7.65mm Model PP," Germany (pre-1945), source and publication date unknown.
The P 38: The First Fifty Years, Unidentified article, p. 152, second full paragraph, publication date unknown.
Characteristics of the P 38, Unidentified article, p. 55, top photo, publication date unknown.
"The 100 Greatest Combat Pistols", p. 188, fourth paragraph, source and publication date unknown.
Unidentified article, "Walther" p. 99, top photo, source and publication date unknown.
Walther PP and PPK Systems, "Signal Pin," p. 35, source and publication date unknown.
Advertisement, Walther, The New P22, under "Features", source and publication date unknown.
The Shotgun News, vol. 56, Issue 24, p. 19, last column, publication date unknown.
Guns Magazine, Ambi Magazine Release, p. 54, second paragraph, source and publication date unknown.
Walther Model PP, Unidentified article, p. 23, second paragraph, source and publication date unknown.
"Model 2 (Walther)", p. 66-67, source and publication date unknown.
American Rifleman, "Star Model 28 9mm Pistol" p. 62, publication date unknown.
Spanish Handguns, Unidentified article, p. 68, source and publication date unknown.
Advertisement, Smith & Wesson Model SW99, source and publication date unknown.
Combat Handguns, New S&W PC 4566 .45ACP, p. 14, middle paragraph, publicaton date unknown.
TSW Pistol, p. 15 (center photo) p. 17 (2nd paragraph), source and publicaton date unknown.
Guns & Weapons For Law Enforcement, "S&W SW1911 .45ACP", by W. Rauch, pp. 19 (center photo), 22-23 (last paragraph to next page), publication date unknown.
Combat Handguns, "Gunfighting, Guns, Gear", pp. 99-100, top photo and center column next page, publication date unknown.
Combat Handguns, Smith & Wesson M 952 9mm, p. 36, publication date unknown.
Advertisement, "Taurus, .45 ACP To The Tenth Power . . . Plus One", source and publication date unknown.
Combat Handguns, "New Products, New CZ-100 American," p. 103, publication date unknown.
Unidentified Article, "New CZ-99," first column, last full paragraph, source and publication date unknown.
Combat Handguns, "Czech Mate!", p. 8, publication date unknown.
Combat Handguns, "New CZ-G2000 9mm", p. 30, publication date unknown.
Unidentified article, Spanish Oviedo Arms, p. 126, source and publication date unknown.
Small Caliber/Backup Pistols, "FEG PA-63," p. 142, publication date unknown.
Unidentified article, Chapter 3, paragraph above "Gaztanaga's Destroyer and Super Destroyer" p. 57, source and publication date unknown.
The Shotgun News, Unidentified article, middle paragraph, pp. 23 (last column, 6th paragraph), 24 (middle column, 2nd paragraph), publication date unknown.
The Shotgun News, Advertisement, "Talon", publication date unknown.
Guns of the Old West, "New Marlin M1897 Cowboy .22", p. 62, middle column, publication date unknown.
Advertisement, "Jennings J-22 Target Pistol", source and publication date unknown.
The P 38: The First Fifty Years, "The P 38's Far-reaching Influences," p. 258, publication date unknown.
Gun World, "Double Action Only Auto", by Tom Ferguson, p. 16, middle column, publication date unknown.
Women&Guns, Unidentified article, p. 34, right photo, publication date unknown.
Combat Handguns, Unidentified article, p. 11, top photo, publication date unknown.
Pistols,7.65mm Sauer Behorden Model, p. 38, source and publication date unknown.
Advertisement, Sigarms Sporting Rifles, Model 90, source and publication date unknown.
"Small Caliber/Backup Pistols", p. 186, first two sentences, source and publication date unknown.
"The Modell 1930 and Behorden", Chapter Eleven, pp. 162, 174, source and publication date unknown.
"J.P. Sauer & Sohn, Suhl", p. 321, paragraph 8; Photos from 1938 Sauer catalog, p. 355, text; "On the S&SP," p. 159, source and publication date unknown.
Guns&Weapons for Law Enforcement, " . . . seven 5.7×28mm", p. 31, publication date unknown.
"Astra Model 200 (Firecat)", p. 43, item/paragraph 1, source and publication date unknown.
"Model 2 (Walther)", pp. 66 (middle column), 67, source and publication date unknown.
Guns & Weapons for Law Enforcement, Unidentified article, p. 69, first column, second paragraph, publication date unknown.

* cited by examiner

FIG. 9
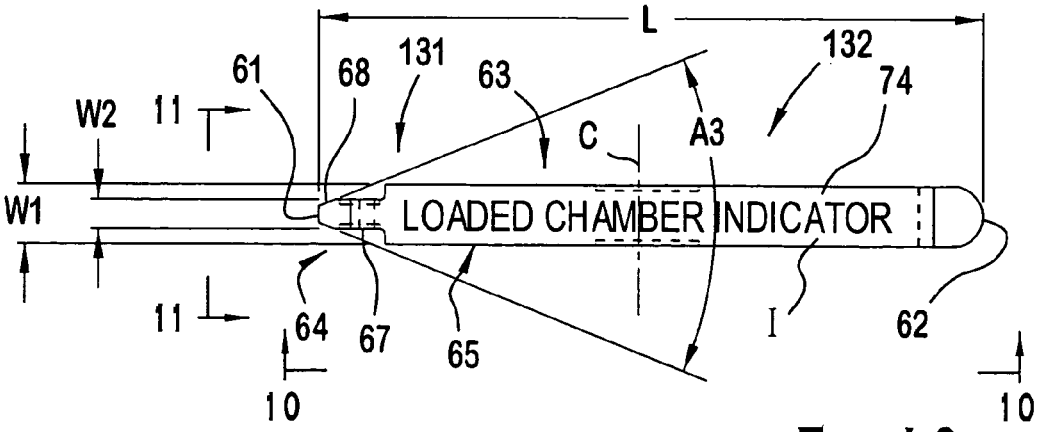
FIG. 10
FIG. 11
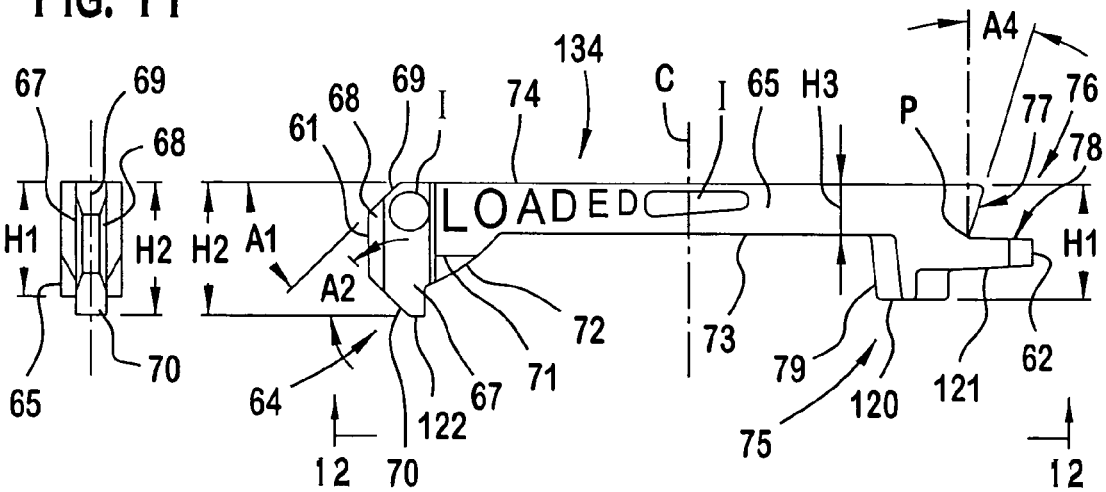
FIG. 12
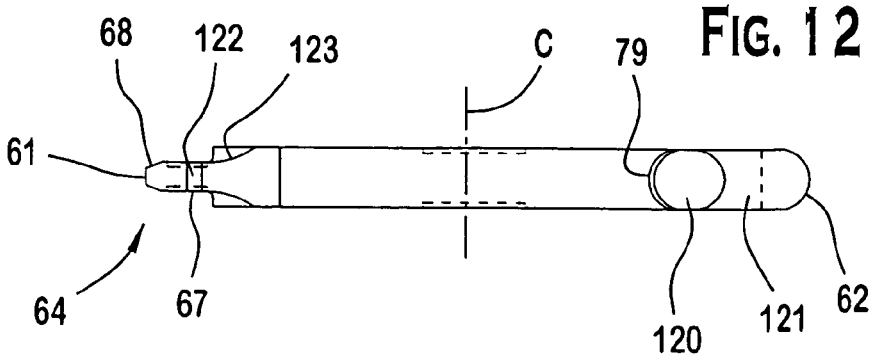

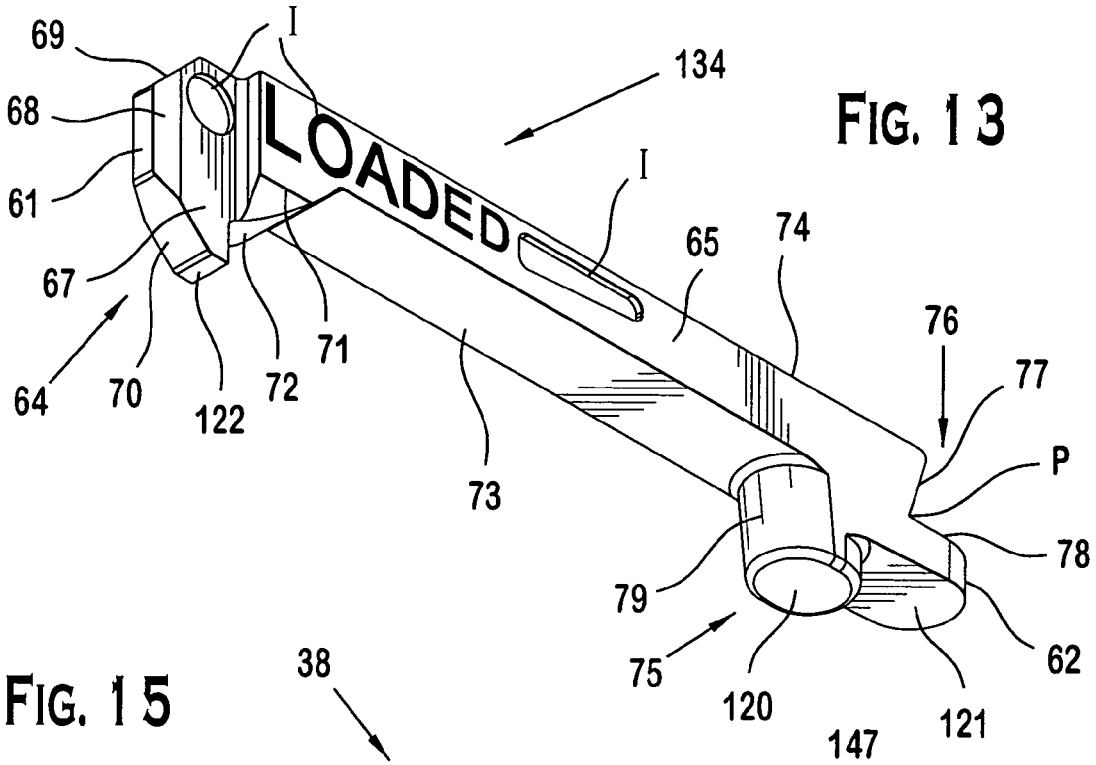
FIG. 13
FIG. 15
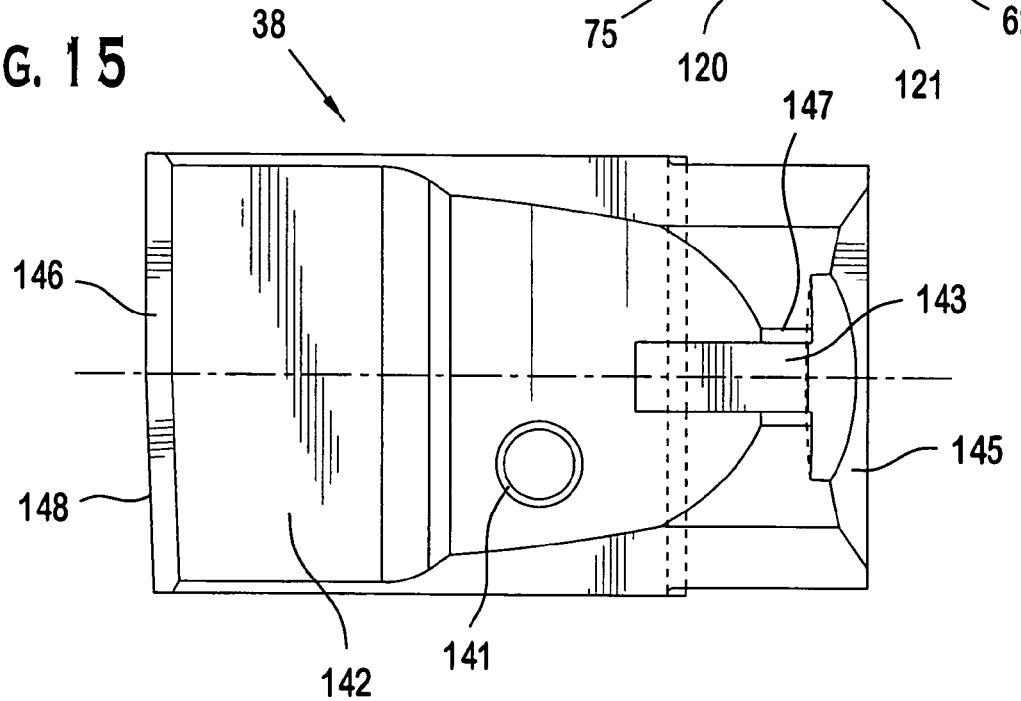
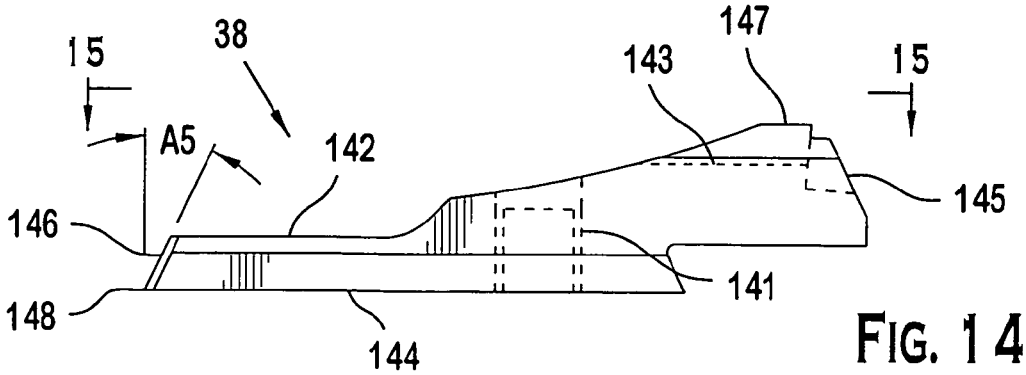
FIG. 14

PISTOL WITH LOADED CHAMBER INDICATOR

BACKGROUND OF THE INVENTION

The present invention generally relates to firearms, and more particularly to a device that indicates the presence of a cartridge in the firing chamber of a pistol (i.e., a "loaded chamber").

Although the loaded condition of a pistol's chamber is customarily and most positively checked by the user opening the action and visually observing the presence of a cartridge therein, there have been prior devices which attempt to augment this procedure by providing a mechanical device to signal the presence of a cartridge in the chamber, particularly in military pistols where opening the chamber and observing the loaded condition of same may not be practical or possible due to the need for stealth or operating in total darkness. In one type of known visual loaded chamber indicator for centerfire pistols, a small viewing window or port is cut through the sides or top of the barrel or chamber wall of a pistol to allow the presence of the cartridge casing in the barrel bore to be seen through the window by a user of the pistol. These small viewing ports, however, are susceptible to blockage by dirt, unburned gun powder residue, carbon build-up, and grease which may obscure the small ports and render these indicators useless. Another drawback is that these viewing-port-type indicators also do not provide a tactile indication to the user, and hence are not useable at night or in other darkened environments.

In another known loaded chamber indicator for centerfire pistols, a larger opening or window is cut into the side rear portion of the barrel or chamber wall. The opening extends radially inwards from outside the barrel and through the barrel's sidewall and rear face against which the rim of a cartridge abuts when a cartridge is loaded into the barrel bore. An elongated thin elastic member is provided that is fixed to the slide or bolt at one end. At the opposite end, the member has a small projection that protrudes through the window in the barrel to contact the side of the cartridge casing when a cartridge is loaded into the barrel. The member, however, is physically deflected outwards only by a very small amount by the cartridge casing. Moreover, the clip would only protrude slightly beyond the external surface of the pistol in a loaded chamber condition, and therefore lacks tactile indication capabilities. Both of these factors make it difficult for a pistol user relying upon a loaded chamber indicator to visually distinguish a change in position of the indicator between a loaded chamber condition and an empty chamber condition.

Another known elongated indicator for centerfire pistols similarly uses a cutout through the chamber wall and a small pivoting toggle. The toggle is relatively short in length and mounted in the top of the pistol about a transverse pivot pin located approximately at the center of the toggle. The front of the toggle contacts a cartridge when loaded into the chamber which displaces the toggle upwards. Although the indicator does protrude slightly beyond the top external surface of the pistol when contacted by the cartridge (i.e., a loaded chamber position), the extent of physical displacement is small due to the shortness of the indicator and centered location of the pivot point. Accordingly, the resulting exposed portion of the indicator is concomitantly small and difficult for the pistol's user to see. The exposed surface of the indicator is also too small to emplace written or symbolic indicia thereon of sufficient size to be readily legible to the user. Moreover, the pinned connection is susceptible to malfunctioning caused by breakage and sticking due to dirt and carbon residue from discharging the pistol, particularly due to the pin's proximity to the chamber area.

Accordingly, there is a need for a loaded chamber indicator that provides a more readily visible, tactile, and reliable indication of the presence a cartridge in the chamber of a pistol than the prior art.

SUMMARY OF THE INVENTION

A loaded chamber indicator for centerfire pistols is provided that advantageously indicates a presence of a cartridge in the firing chamber to a pistol user from a visual and tactile standpoint in contrast to known indicators. The loaded chamber indicator also provides exposed surfaces in a displaced loaded-chamber-condition position that are sufficiently large enough to emplace legible written and/or symbolic indicia to communicate a loaded chamber condition to the pistol user. Because in one embodiment the indicator may be pivotally connected to the pistol without a pin by using a novel mount also disclosed herein, the indicator mechanism enhances reliable indications due to its mechanical simplicity.

A preferred embodiment of a centerfire pistol having a loaded chamber indicator generally includes a frame, a housing having an external surface and a fulcrum about which a loaded chamber indicator may be engaged, a chamber defined in the housing to receive a cartridge, a barrel unit, and an indicating element. In one embodiment, the housing may be a slide that is slidably mounted on the frame and is movable in a reciprocating manner in a longitudinal axial direction.

Preferably, the indicating element is an elongated lever-type bar that may be top-mounted to the pistol. In one embodiment, the indicating element may be mounted in the housing behind the chamber. The indicating element is movable between an unloaded-chamber-indication position and a loaded-chamber-indication position. In the latter position, a cartridge in the chamber of the pistol preferably contacts and acts on the front of the indicating element causing the element to be displaced upwards and protrude outwards beyond the external surface of the housing to expose at least part of the indicating element. In one embodiment, by anchoring the rear of the indicating element to the housing, the indicating element may be made appreciably longer and have a larger indication displacement than known indicators. This concomitantly exposes a greater surface area of the indicating element in the loaded-chamber-indication position, and allows adequate space to add legible written and/or symbolic indicia to indicate that the chamber is loaded.

The indicating element may have a first end, a second end, and a center therebetween equally spaced from both ends. In one embodiment, the first end is a front end and the second end is a rear end. In one embodiment, the indicating element is pivotally engaged with the fulcrum between the center and one of the two ends. In another embodiment, the indicating element is engaged with the fulcrum proximate to the rear end of the indicating element. The indicating element preferably may be positioned in the housing to contact and be displaced by the cartridge, and preferably simultaneously protrude outwards from the external surface of the housing to provide a pistol user with a visual and tactile indication that the cartridge is loaded in the chamber (i.e., a "loaded chamber-indication" position).

According to another aspect of the preferred embodiment, a biasing member such as a spring may be provided which is associated with the loaded chamber indicating element. The spring may be disposed in the slide and interacts with the indicating element to preferably bias the indicating element away from the loaded-chamber-indication position described above. In one embodiment, the biasing member may be a helical spring.

In one embodiment, the indicating element may have a sensor surface configured to contact and detect the cartridge, and a signal area to identify and communicate the presence of a cartridge in the chamber. Preferably, the signal area may protrude outwards and away from the external surface of the pistol in the loaded-chamber-indication position. The signal area has an ornamental shape which in one embodiment may also include an ornamental written, graphic, colored, and/or other suitable indicia or combination thereof on one or more of its surfaces to denote a "loaded chamber" condition.

A method of indicating a loaded pistol chamber is also provided including: loading a cartridge into a chamber of a pistol having a housing with an external surface; contacting an elongated element having two ends at one end with the cartridge; pivoting the element about an opposite end by the cartridge contact; displacing the element; and protruding at least part of the element outwards from the external surface of the housing to a loaded-chamber-indication position to signal a loaded chamber condition to a user of the pistol. In one embodiment, the method further includes breaking contact between the cartridge and the element and retracting the element inside the housing to an unloaded-chamber-indication position. In yet another embodiment, the method includes the step of placing indicia on the part of the element that protrudes outwards from the external surface of the housing to communicate a loaded chamber condition retracting the indicating element inside the pistol to an unloaded-chamber-indication position in the absence of contact between the indicating element and cartridge rim.

As the terms are used herein, the "front" of a pistol is defined as the barrel end and the "rear" of a pistol is defined as the handle or grip end. The "left side" of a pistol is defined as the side visible when the barrel points towards the left and the "right side" is the side visible when the barrel points to the right. With the barrel positioned parallel to the ground, the term "top" in reference to the pistol is defined as the upper portion generally containing the aiming sight. The term "bottom" in reference to the pistol is defined as the lower portion generally containing the trigger. Also as the terms may be used herein with respect to orientation using the pistol as a frame of reference to direction, "forward" indicates a direction towards the muzzle (front of barrel) end of the pistol and "rearward" indicates a direction towards the handle or grip end of the pistol. "Downwards" indicates a direction towards the bottom or underside of the pistol and "upwards" indicates a direction towards the top of the pistol opposite the bottom or underside. "Behind" indicates a location or position to the rear.

Although the preferred embodiment of a indicating element is particularly suited for use with pistols that utilize centerfire-type ammunition, the preferred embodiment may be beneficially used with other centerfire self-contained cartridges where indication of a loaded chamber condition is desired. It is not considered practical to be utilized in rimfire-type autoloading pistols, in that their relatively thin cartridge cases might be subject to rupturing when fired in a chamber which may have areas relieved to accommodate the described embodiment.

BRIEF DESCRIPTION OF THE DRAWINGS

The features of the preferred embodiments will be described with reference to the following drawings where like elements are labeled similarly, and in which:

FIG. 9 is a top view of the loaded chamber indicator of the pistol of FIG. 1;

FIG. 10 is a side view of the loaded chamber indicator of FIG. 9;

FIG. 11 is a front view of the loaded chamber indicator of FIG. 9;

FIG. 12 is a bottom view of the loaded chamber indicator of FIG. 9;

FIG. 13 is a bottom perspective view of the loaded chamber indicator of FIG. 9;

FIG. 14 is a side elevational view of the rear sight of the pistol of FIG. 1; and FIG. 15 is a top view of the rear sight of FIG. 14.

DESCRIPTION OF THE PREFERRED EMBODIMENTS

A preferred embodiment of the loaded chamber indicator will now be described for convenience with reference to a centerfire-type pistol in the form of an auto-loading pistol that uses centerfire cartridges (i.e., primer located in center of base of cartridge).

Figure 1:
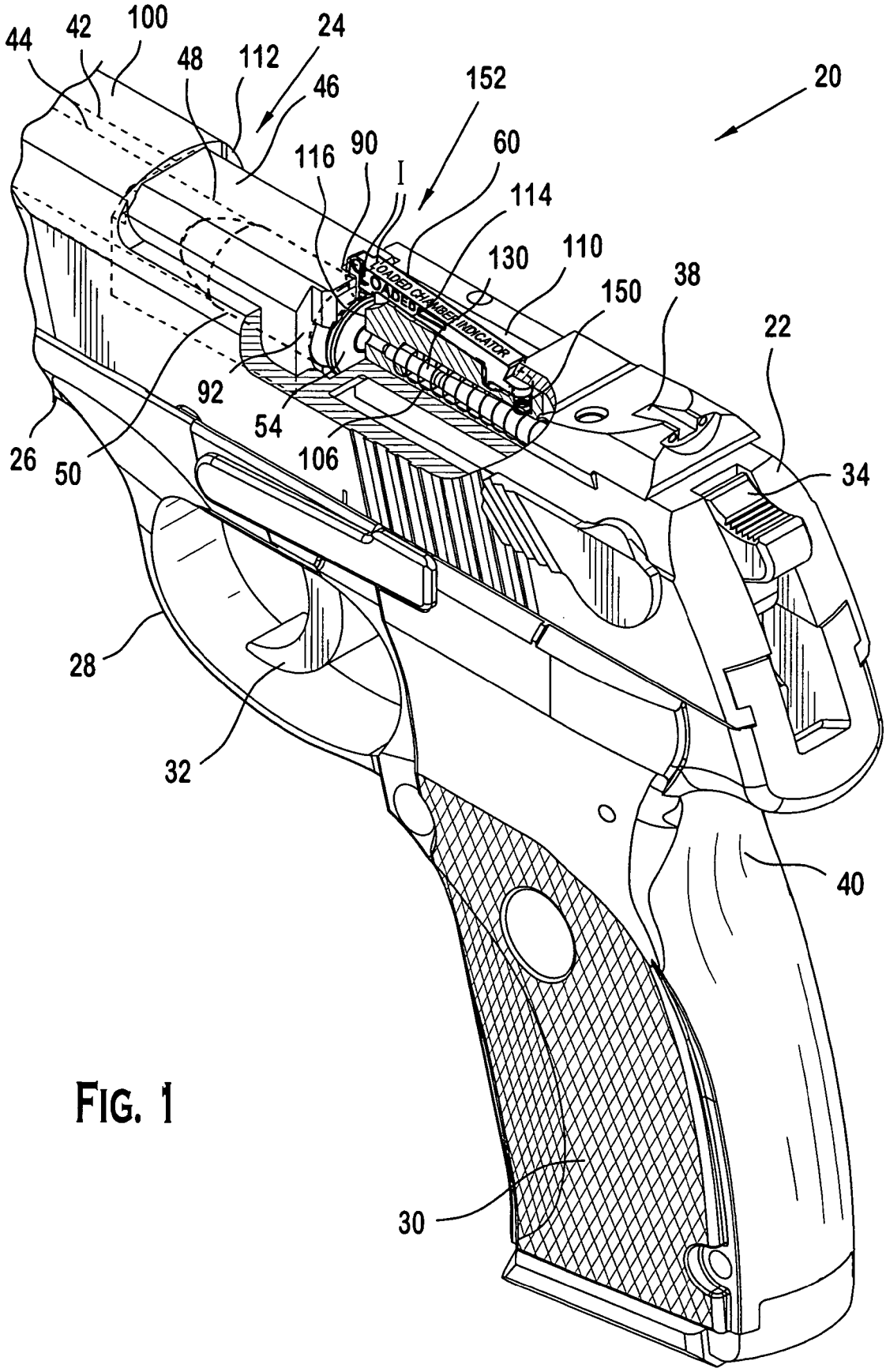
FIG. 1 is a rear perspective of one embodiment of a firearm in the form of a centerfire autoloading pistol having a loaded chamber indicator in which a portion of the exterior of the pistol is removed to reveal the chamber and a cartridge loaded in the chamber.
Figures 2, 3:
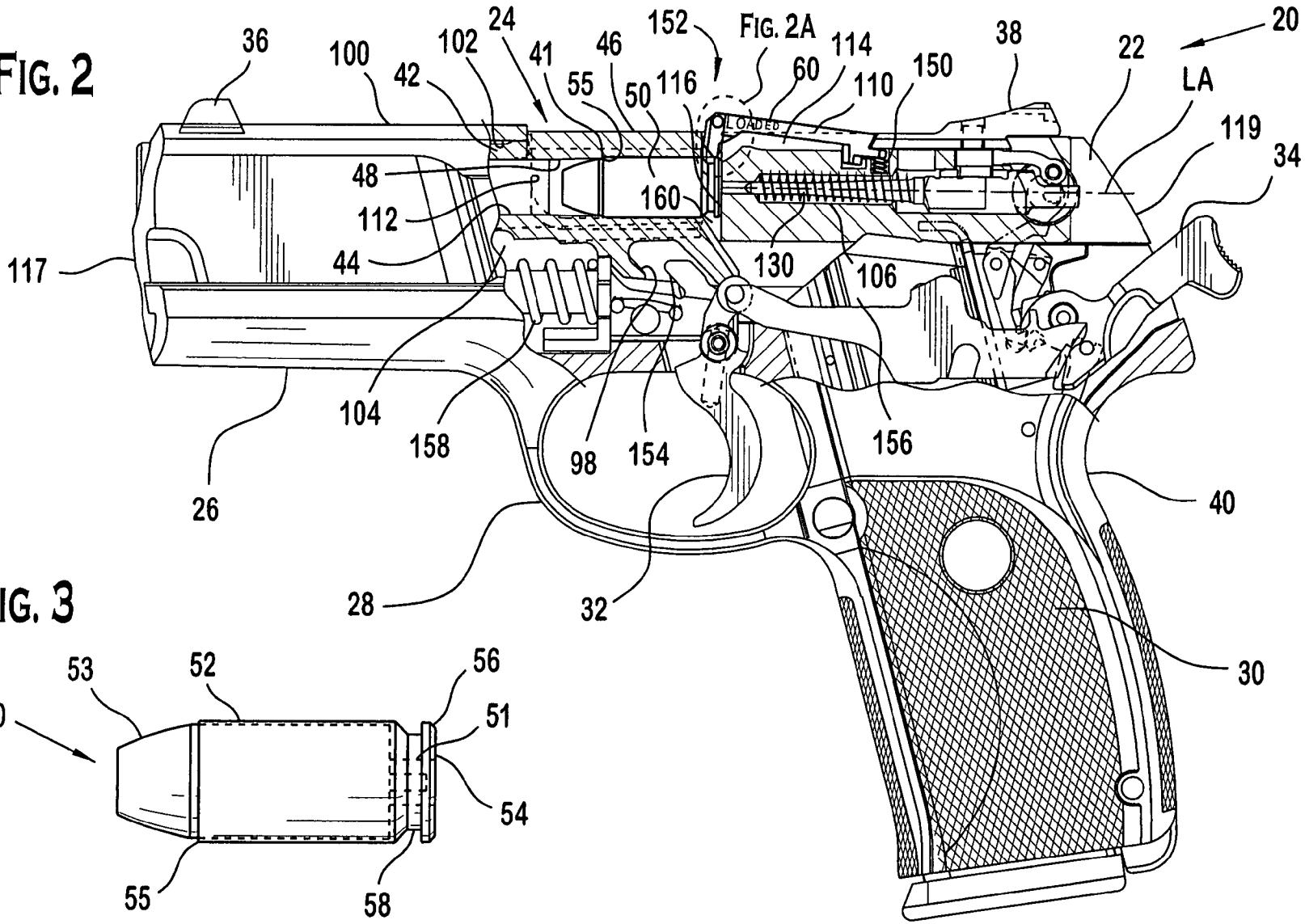
FIG. 2 is a left side elevational view of the pistol of FIG. 1 with a portion cut away to reveal internal components, and showing a cartridge loaded in the chamber and the housing and barrel unit in a fully forward position.
FIG. 3 shows a cartridge of the centerfire type that is useable with the pistol of FIG. 1.
Figure 2A:
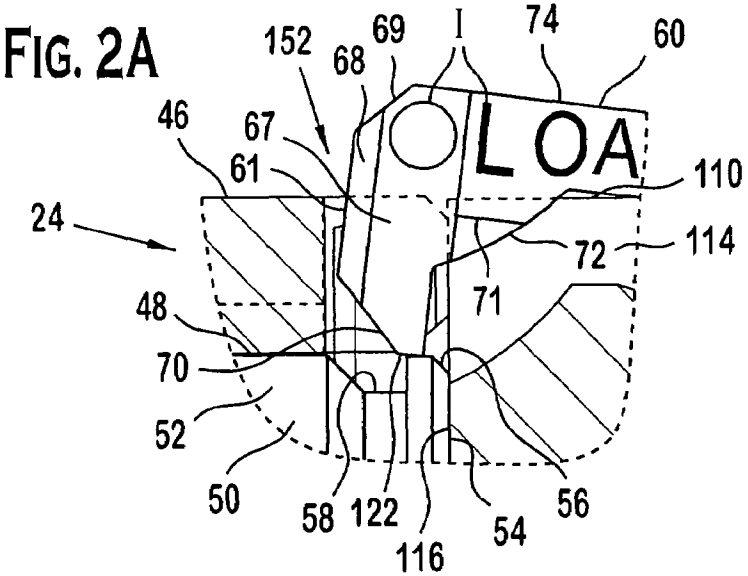
FIG. 2A is a detailed view taken from FIG. 2 and shows the loaded chamber indicator in an activated position.

Referring particularly to FIGS. 1-2, a pistol 20 generally includes a housing such as slide 22, a longitudinally-extending barrel unit 24, a frame 26 including a trigger guard 28, grip frame 40 and a hand grip 30 mounted thereon, a firing pin 130, a trigger 32, a hammer 34, a front sight 36, and a rear sight 38. Grip frame 40 may hold a removable magazine 156 with spring-loaded follower which is capable of holding and dispensing a plurality of cartridges for automatic loading of pistol 20. An indicating element 60, which serves as a loaded chamber indicator, is provided which in a preferred embodiment may be an elongated bar-type lever, as shown. Individual components of pistol 20 will now be described in more detail.

Figure 7:
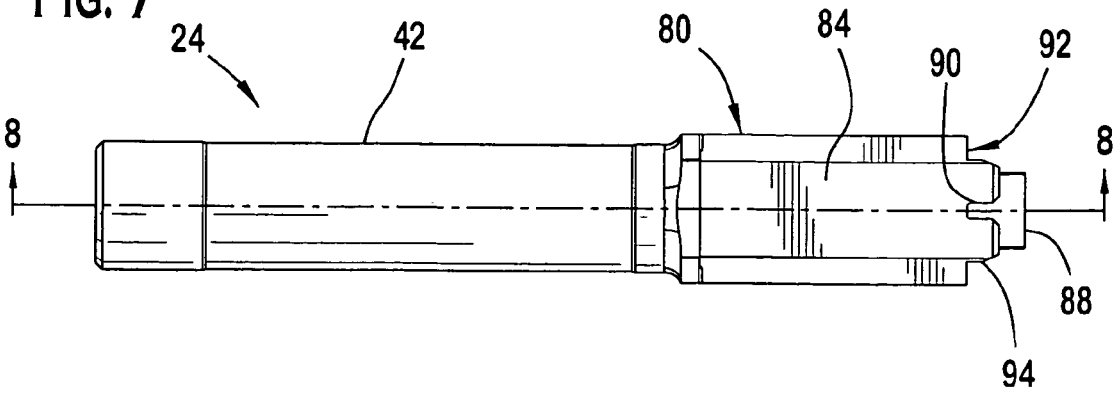
FIG. 7 is a top view of the barrel unit of the pistol of FIG. 1.
Figure 7A:
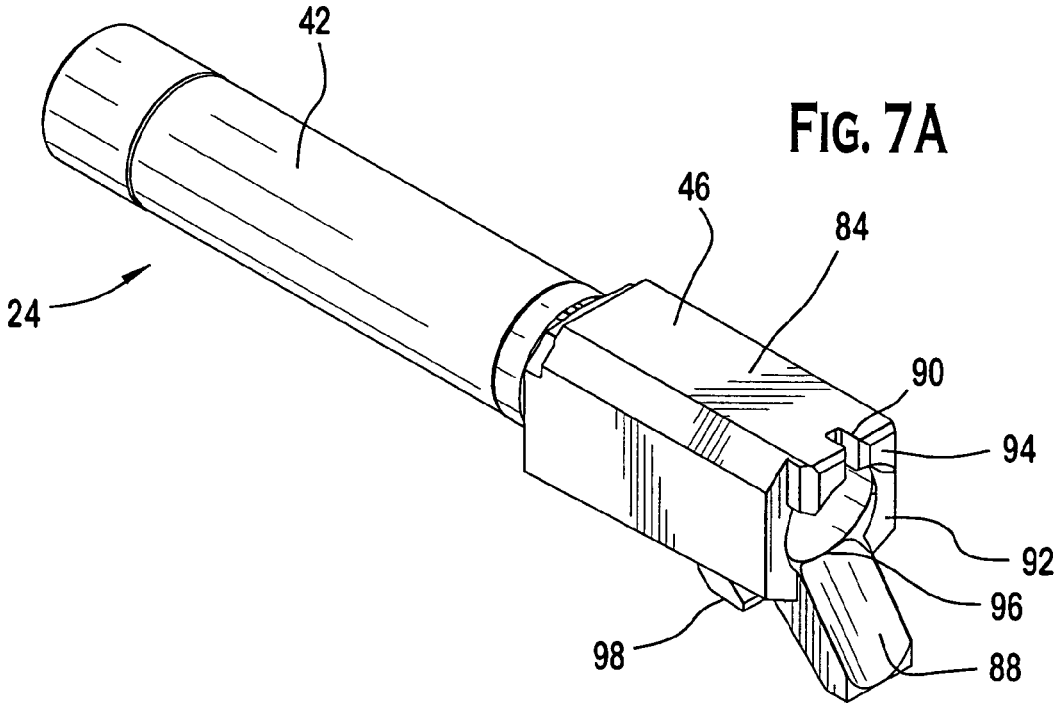
FIG. 7A is a rear perspective view of the barrel unit of FIG. 7.
Figure 8:
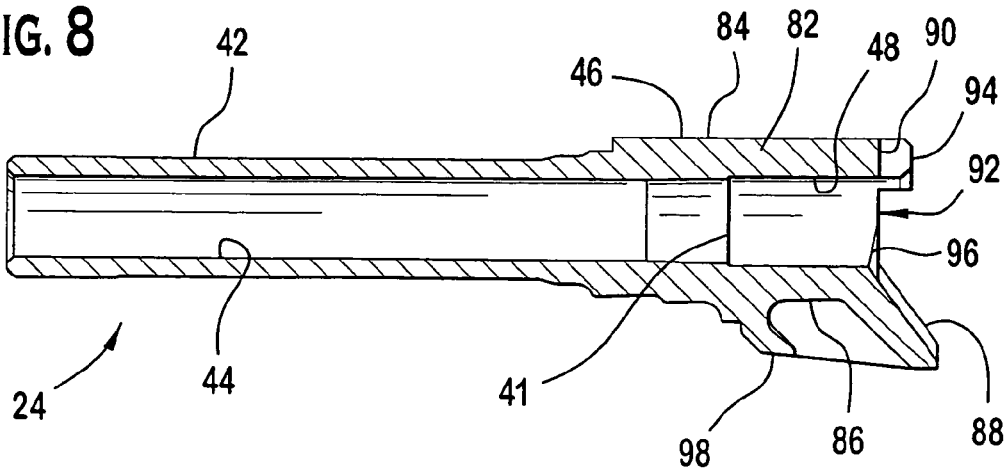
FIG. 8 is a side cross-sectional view of the barrel unit of FIG. 7 taken along line 8-8 in FIG. 7.

With additional reference to FIGS. 7-8, barrel unit 24 includes a barrel 42 having a barrel bore 44 and chamber block 46 at the rear end of barrel unit 24. Chamber block 46 may be integral with barrel 42 or a separate component connected to barrel 42. In one embodiment, barrel unit 24 is preferably disposed at least partially inside slide 22. It will be noted that chamber block 46 may have any suitable overall size and three-dimensional shape (e.g., rectangular or square block, cylindrical, etc.) so long as the chamber block is capable of fitting inside slide 22. In a preferred embodiment, chamber block 46 is rectangular in shape. Chamber block 46 may preferably, but not necessarily, have outside dimensions in cross-section that are larger than barrel 42, as shown.

Chamber block 46 includes a chamber 48 which in a preferred embodiment may be a cylindrical bore that is concentrically aligned with barrel bore 44. Chamber 48 is sized and configured to receive and hold a cartridge 50, which in one embodiment of pistol 20 may be loaded forward in pistol 20 from a magazine 156 in preparation for firing. After firing, the spent cartridge casing is extracted rearwards from chamber 48 and ejected from pistol 20.

Barrel bore 44 and chamber 48 collectively define a longitudinal axis "LA" for pistol 20 passing therethrough along an axial centerline through bore 44 and chamber 48. The term "longitudinal" as used herein indicates in direction parallel to the longitudinal axis LA. A transverse axis "TA" is defined perpendicular to the longitudinal axis LA. The term "transverse" as used herein indicates a direction towards either side of pistol 20 and parallel to the transverse axis TA With further reference to FIGS. 7-8, chamber block 46 may further include sidewalls 80 on either side of chamber 48, a top wall 82 having an upper surface 84, a bottom wall 86 having a downwardly-projecting cam protrusion 98 and a downwardly-projecting inclined ramp protrusion 88 to facilitate loading a cartridge into chamber 48 from the magazine, and a rearwardly-facing rear breech surface 92 surrounding chamber entrance 96. Rear breech surface 92 may further include an upper rear projection 94 extending rearwardly in a longitudinal direction therefrom and disposed above chamber entrance 96. Upper rear projection 94 serves to provide clearance space 160 between rear breech surface 92 and breech face 116 of slide 22 to accommodate annular rim 56 and extractor groove 58 of cartridge 50 (see FIG. 4).

In the preferred embodiment, a downwardly and rearwardly-extending slot 90 is provided in upper rear projection 94 to receive indicating element 60. In the downward direction, slot 90 preferably extends completely through upper rear projection 94 to meet rear breech surface 92 at entrance 96 to chamber 48. In the rearward direction, slot 90 preferably also extends from rear breech surface 92 of chamber block completely through upper rear projection 94 in a direction parallel to longitudinal axis LA of pistol 20. In one embodiment, slot 90 slidably receives indicating element 60 and allows indicating element 60 to contact a cartridge 50 when being loaded into and when fully seated in chamber 48, as will be further described below.

As best shown in FIG. 3, a cartridge 50 useable with the preferred embodiment may include a casing 52, a projectile 53 disposed in casing 52, a base 54, an annular rim 56 at the base, and an extractor groove 58. Headspace surface 55 at the top edge of casing 52 is stepped in shape and corresponds with a mating step-shaped headspacer 41 in chamber 48 to stop cartridge 50 in a fully-seated position when loaded in chamber 48 (see FIG. 2). Cartridge base 54 may have a primer cup 51 disposed in the center of base 54 which contains the primer material in the case of a centerfire-type cartridge. Depending on the specific type of cartridge being used, rim 56 may have a diameter that is smaller than the diameter of casing 52 (reduced or rebated rim cartridge), the same size (rimless cartridge), or larger (rimmed cartridge). It will be appreciated that numerous types of cartridges may be used with the preferred embodiment without limitation so long as indicating element 60 is displaceable by contact with the cartridge when loaded into chamber 48 and results in a change in position in indicating element 60, as will be further described herein.

Figure 4A:
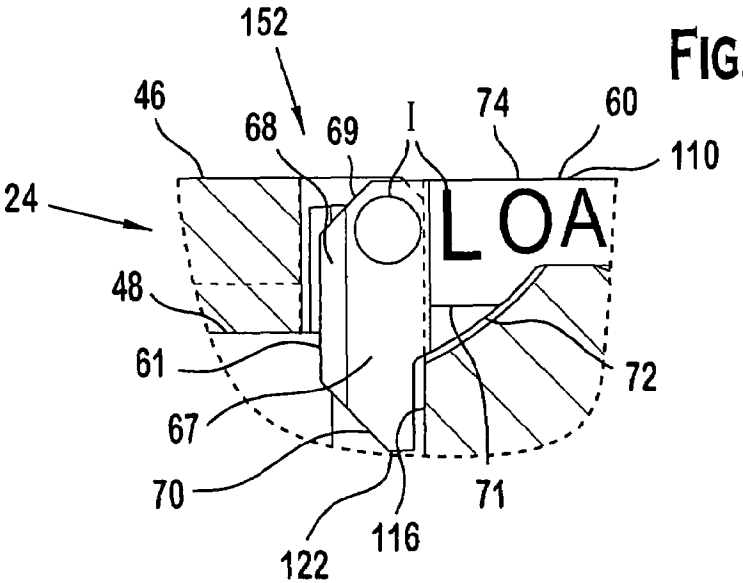
FIG. 4A is a detailed view taken from FIG. 4 and shows the loaded chamber indicator in a deactivated position.
Figure 4:
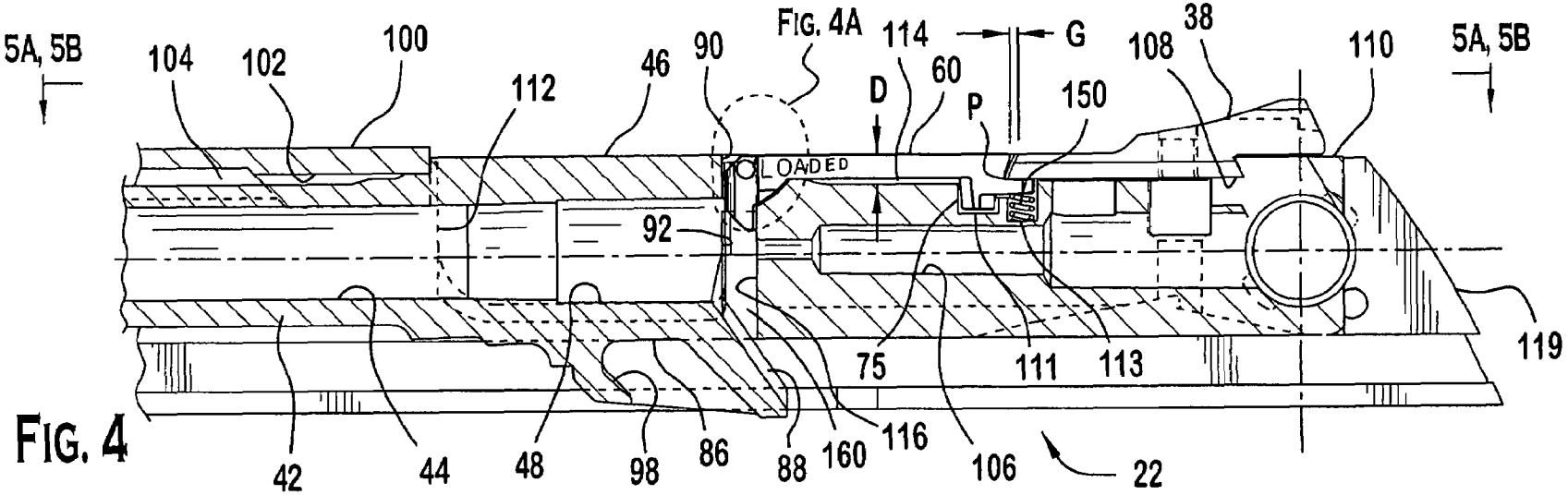
FIG. 4 is a left side elevational view of the housing and barrel unit of the pistol of FIG. 1.
Figure 5A:
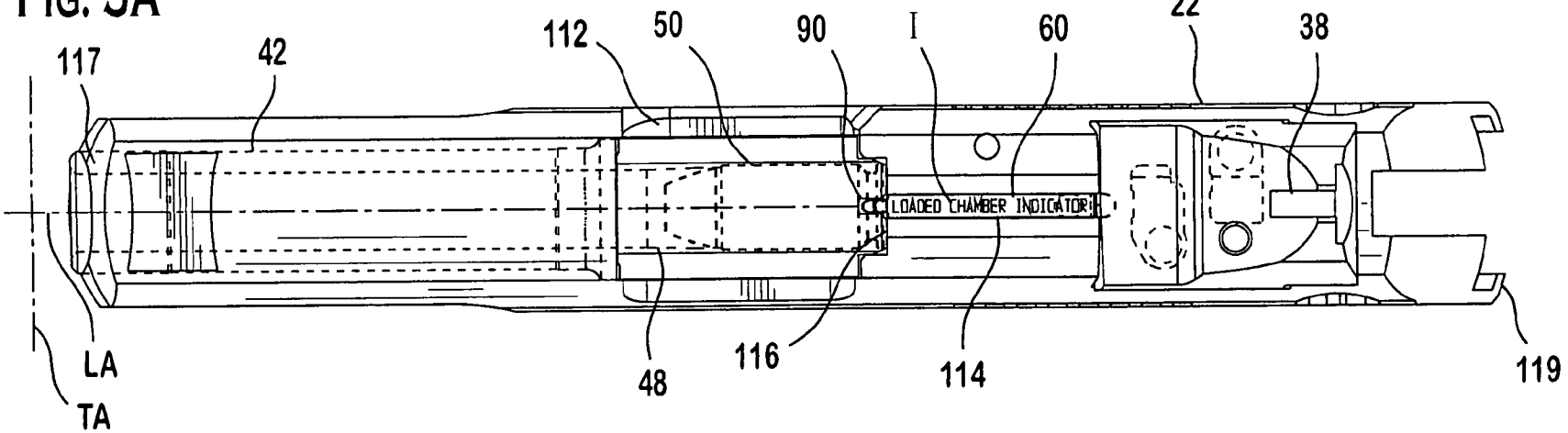
FIG. 5A is a top view of the pistol of FIG. 4 with the cartridge of FIG. 3 shown in dashed lines.
Figure 5B:
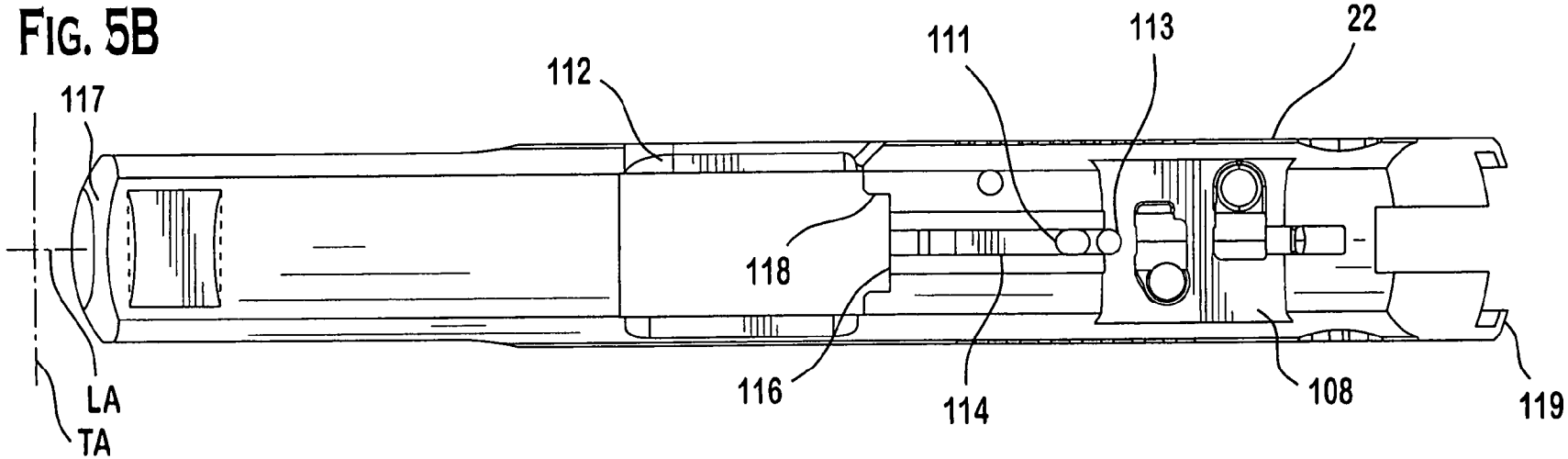
FIG. 5B is top view of the pistol of FIG. 4 with the chamber indicator and rear sight removed.
Figure 6:
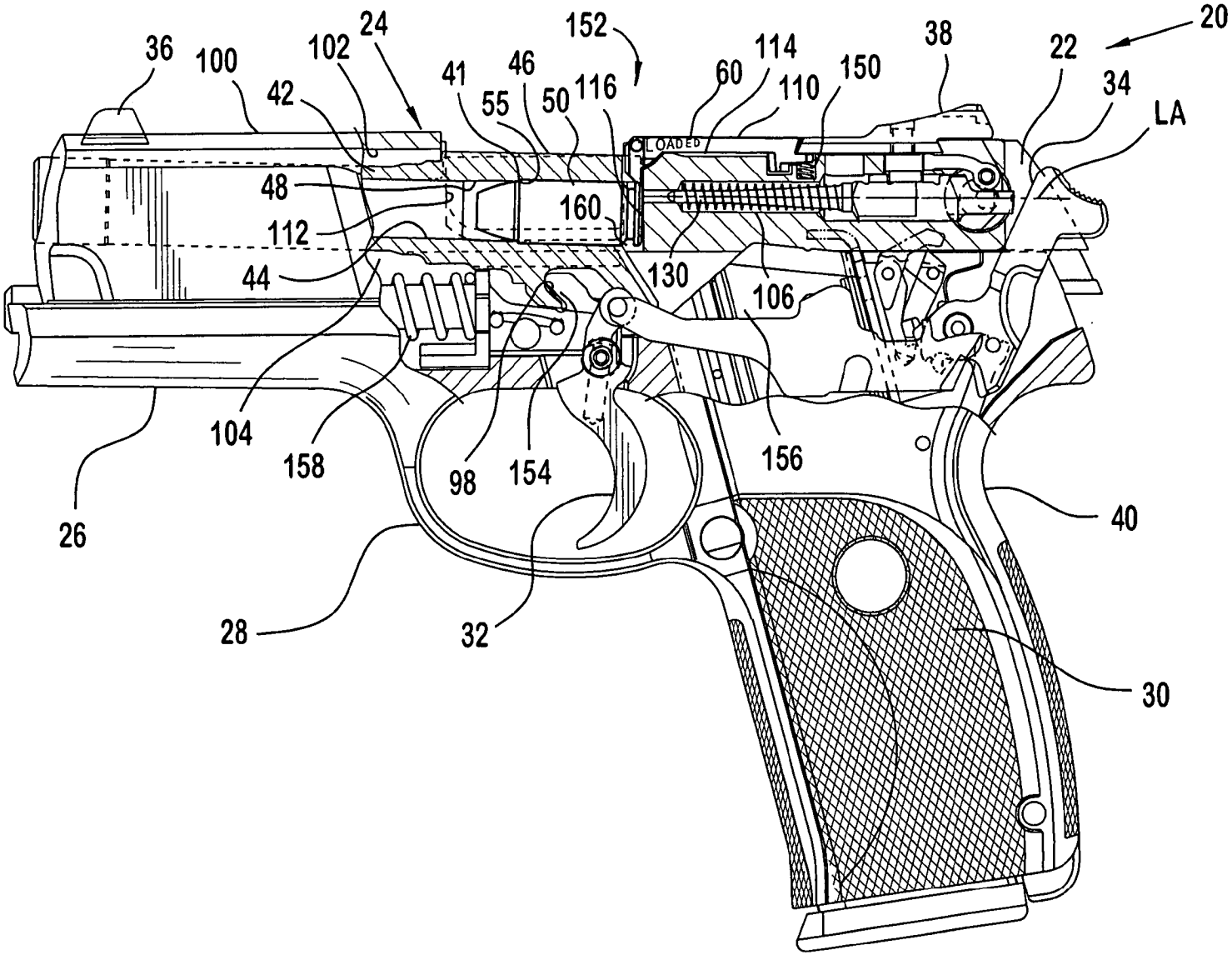
FIG. 6 is a left side elevational view of the pistol of FIG. 1 with a portion cut away to reveal internal components, and showing a cartridge loaded in the chamber and the housing and barrel in partially forward position.

With additional reference now to FIGS. 4-6, slide 22 has a front end 117 (barrel end) and a rear end 119 (hammer end). In one embodiment, slide 22 in may be slidably mounted on frame 26 via a rail system (not shown) and is biased in a forward direction preferably by a recoil spring 158. Slide 22 slidably reciprocates in a forward and rearward axial direction in response to recoil forces developed in discharging pistol 20 and the spring return force. During its rearward motion, slide 22 permits a spent cartridge casing 52 (i.e., after discharging pistol 20) to be ejected and a new cartridge 50 to be uploaded from the magazine. A new cartridge 50 is loaded into the chamber by slide 22 during its forward return motion.

Slide 22 may be partially hollow in structure and include a plurality of external surfaces 100 and internal surfaces 102. In the forward portion of slide 22, internal surfaces 102 define a downwardly-open forward internal cavity 104 to house at least a part of barrel unit 24 which is in operational relationship with slide 22. Preferably, barrel unit 24 is slidably received in slide 22 such that slide 22 and barrel unit 24 may move independently from each other for purposes to be explained below in conjunction with the operation of pistol 20. The rear portion of slide 22 contains a forwardly-facing breech face 116 which abuts and supports base 54 of cartridge 50 when the cartridge is loaded in chamber 48. Breech face 116 may have a breech face notch 118 which receives upper rear projection 94 projecting rearwardly from chamber block 46 and above chamber 48, as described above. In conjunction with upper rear projection 94, breech notch 118 serves to close up the area to the rear of chamber 48 when chamber block 46 is positioned in ejector port 112 such as when a cartridge is fully chambered and readied for firing.

Slide 22 may further include an external top surface 110, which constitutes part of slide external surfaces 100, and may extend substantially along the entire length of slide 22. A generally flat and wide horizontal landing surface 108 may be provided near the rear of top surface 110 to mount rear sight 38 on slide 22. An ejector port 112 may also be provided which extends laterally and downwardly through slide 22, and opening into internal cavity 104. When pistol 20 is in the ready position for firing with cartridge 50 loaded in chamber 48 (see, e.g., FIGS. 2 and 6), chamber 48 is visible through and substantially blocks ejector port 112. When slide 22 is forced rearwards by firing pistol 20, ejector port 112 moves beyond chamber 48 and opens allowing a spent cartridge casing to be ejected through port 112.

Slide 22 further includes a firing pin cavity 106 configured to receive firing pin 130. In one embodiment, firing pin cavity 106 preferably is concentrically aligned with the centerline of chamber 48 at breech face 116. This aligns firing pin 130 to strike the center of cartridge base 54 where the primer cup 51 is located to fire pistol 20. Firing pin cavity 106 preferably matches the shape of firing pin 130, and in one embodiment as shown may include several cavities having different internal diameters to accommodate the shape of firing pin 130.

Firing pin 130 preferably has a longitudinally reciprocating forward stroke and rearward motion, and is mechanically actuated by trigger 32. Firing pin 130 is disposed in firing pin cavity 106 and may be biased by a spring (not shown ) in a rearward direction opposite chamber 48 as noted above. Hammer 34 is mechanically linked to trigger 32. Pulling trigger 32 causes hammer 34 to drop forward from the ready-to-fire position (as shown in FIG. 2) and strike the rear of firing pin 130. Firing pin 130 is forced forward against the spring force and strikes the cartridge primer cup to set off the charge.

In the preferred embodiment, a longitudinally-extending slot 114 may be provided in slide 22 to slidably receive indicating element 60. Preferably, slot 114 is elongated and disposed in top surface 110 of slide 22. In one embodiment, slot 114 has a generally rectilinear shape (best shown in FIG. 5B). Slot 114 is preferably oriented in a parallel direction to top surface 110. In one embodiment as shown, slot 114 has a length extending rearwards from the rear of ejector port 112 to a point near rear sight 38, as explained in more detail below. Slot 114 has a depth D, as shown in FIG. 4, which may vary along the length of slot 114 to coincide with the shape of indicating element 60. The rear portion of slot 114 may further include a base landing 111 to receive base 120 of indicating element 60 and a cylindrical indentation 113 capable of holding a biasing member such as a helical spring, as will be further described below.

With reference to FIGS. 14 and 15, rear sight 38 preferably is mounted to horizontal landing surface 108 in top surface 110 of slide 22. Rear sight 38 has a top surface 142, bottom surface 144, rear end 145, and a front sloping surface 146. The intersection of surfaces 144 and 146 define a leading edge 148 which functionally interacts with indicating element 60 to pivotally mount indicating element 60 to slide 22, as will be further described below. Rear sight 38 further includes a top sighting surface 143 which in one embodiment is preferably recessed below spaced-apart peak surfaces 147 at the rear of sight 38. Preferably, rear sight 38 is mounted to landing surface 108 of slide 22 via a press-fit dovetail connection between slide 22 and rear site 38. A threaded fastener (not shown) is insertable through threaded fastener hole 141 in rear sight 38 which abuts landing surface 108 as added security.

Referring to FIGS. 1-6, pistol 20 further includes a movable indicating element 60 which identifies and communicates the presence of a cartridge 50 in chamber 48 (i.e., a "loaded chamber") to a user of the pistol. Indicating element 60 provides a visual and tactile indication or signal to the user of a loaded chamber condition, as further described below.

In the preferred embodiment, indicating element 60 may be mounted in slide 22, and more preferably indicating element 60 is disposed in slot 114 located in top surface 110 of slide 22 (see, e.g., FIG. 5A). Indicating element 60 may be pivotally mounted in the slide 22 about a pivot point P. Preferably, indicating element 60 is positioned in slide 22 such that at least a portion of indicating element 60 may be contacted and operably engaged by cartridge 50 when the cartridge is being loaded into and fully seated in chamber 48. In one embodiment, indicating element 60 is substantially contained within slide 22 when not in operable contact with cartridge 50 (i.e., the unloaded-chamber-indication position). This serves to distinguish the loaded-chamber-indication position wherein at least part of indicating element 60 preferably protrudes outwards from the external surfaces 100 of slide 22 to provide a positive visual and tactile indication that a cartridge 50 is loaded in chamber 48.

It will be appreciated that other mounting positions of indicating element 60 are possible so long as indicating element 60 is mounted close enough to chamber 48 such that at least a portion of indicating element 60 may come into operable contact with and be displaceable by cartridge 50 when the cartridge is being loaded into and fully seated in chamber 48.

With particular reference on FIGS. 9-13, the preferred embodiment of indicating element 60 will be described in greater detail. Preferably, indicating element 60 may be an elongate lever bar, as shown. However, it should be noted that other suitable embodiments and configurations of an indicating element 60 are possible so long as the indicator is displaceable to a loaded chamber position by contact with the cartridge. Accordingly, the invention is not limited by the preferred embodiment of indicating element 60 to now be described.

As shown in the referenced figures, indicating element 60 includes a front end 61, rear end 62, and mid-portion 63 disposed between the ends. Rear end 62 may have a rounded curved or arcuate shape, as shown. Mid-portion 63 has a bottom surface 73, a top surface 74, and two longitudinally-extending and opposing side surfaces 65 connecting the top and bottom surfaces, thereby defining a height H3 (as shown in FIG. 10) for mid-portion 63. Mid-portion 63 has an overall width W1 and overall length L measured from front end 61 to rear end 62 and defining a center C located equidistant from each of the ends 61, 62. Center C in turn defines a front half 131 from center C to front end 61 and a rear half 132 from center C to rear end 62. Width W1 may be relatively uniform along length L or may vary at one of more locations as a matter of design choice.

In one embodiment, width W1 may typically be at least 0.10 inches wide, preferably at least 0.120 inches wide. Length L may typically be at least 1.0 inches long, preferably at least 1.25 inches long. Height H3 may typically be at least 0.090 inches high, preferably at least 0.10 inches high.

Indicating element 60 further includes a sensor portion 64 which makes operable contact with and engages cartridge 50. Preferably, sensor portion 64 is disposed on the front of indicating element 60; however, other locations on indicating element 60 are possible so long as sensor portion 64 may make operable contact with cartridge 50. In a preferred embodiment, sensor portion 64 has a width W2 which may be smaller than width W1 of mid-portion 63. In one embodiment, width W2 may typically be at least 0.04 inches wide, preferably at least 0.05 inches wide. Because sensor portion 64 slidably moves through slot 90 in upper rear projection 94 of chamber block 46, the narrower width W2 of sensor portion 64 preserves the structural integrity of upper rear projection 94 by minimizing the amount of material needed to be removed from upper rear projection 94 to accommodate sensor portion 64. Upper rear projection 94 experiences high impact loads when struck by slide 22 during the cartridge loading sequence and also helps maintain the seal to the rear of chamber 46 during firing. Projection 94 also helps support the cartridge case during the high pressure exposure of the burning propellant.

Sensor portion 64 further includes vertical side surfaces 67 on either side of sensor portion 64, and forward-facing leading surface 61 therebetween side surfaces 67 which preferably is vertical and contiguous with horizontal sloping upper and lower surfaces 69, 70 located above and below leading surface 61, respectively. Sloping upper and lower surfaces 69, 70 are both preferably sloped in the front-to-back direction in the horizontal plane at an angle A1 and A2, respectively, as shown. Vertical slanting side surfaces 68 are disposed adjoining either side of leading surface 61, and preferably are slanted in a front-to-back direction in the vertical plane at an angle A3 to each other, as shown. During the forward movement of slide 22 when loading a cartridge 50 into chamber 48, sensor portion 64 of indicating element 60 enters into the rear of slot 90 in rear projection 94 of chamber block 46, as described in detail below. The foregoing sloping surfaces 69, 70 and slanting surfaces 68 facilitate a smooth entrance of sensor portion 64 into slot 90.

Preferably, sloping upper and lower surfaces 69, 70 may be disposed at an angle A1, A2 from about 0-90 degrees to the horizontal plane, respectively. In the preferred embodiment, angles A1 and A2 are both 45 degrees. As explained further below, because primarily lower slanting surface 70 makes initial physical contact with cartridge 50 during the forward movement of slide 22 when a cartridge is loaded in chamber 48, angle A2 preferably is more than 0 degrees and less than 90 degrees so that sloping surface 70 has some front-to-back angle to facilitate smooth contact and engagement with the base 54 and rim 56 of cartridge 50. However, one or both of sloping surfaces 69, 70 may have angles A1, A2 of 0 or 90 degrees so as to be completely parallel or perpendicular to the horizontal plane with no angle thereto.

Preferably, slanting side surfaces 68 may be disposed at an angle A3 to each other from about 0-90 degrees in the vertical plane. In the preferred embodiment, slanting surfaces 68 are disposed at an angle A3 of 45 degrees to each other. However, it should be recognized that is possible in one embodiment to eliminate slanting surfaces 68 such that leading surface 61 of sensor portion 69 constitutes the entire width W2 of sensor portion 69 which then would sides disposed at 90 degrees to leading surface 61.

It will be appreciated that any suitable angle may be used for any of the foregoing sloping surfaces 69, 70 or slanting surfaces 68 so long as a smooth entrance of sensor portion 64 may be facilitated. Moreover, any of the sloping surfaces 69, 70 or slanting surfaces 68 may be disposed at an angle different from any of the other sloped or slanted surfaces as a matter of design choice.

With continuing reference to FIGS. 9-13, sensor portion 64 may be a generally downwardly-projecting structure being flush on top with top surface 74 of indicating element 60, but extending downwards below lower surface 73 of indicating element 60. Accordingly, in one embodiment, sensor portion may have a height H2 which preferably is larger than height H3 of mid-portion 63 of indicating element 60. Since only sensor portion 64 must be of a sufficient height to contact cartridge 50, mid-portion 63 may be shorter in height to minimize the required depth of slot 114 and intrusion into the structure of slide 22.

In one embodiment, a forward part of lower surface 73 of indicating element 60 may be a cam-shaped surface 72 to provide a smooth transition from mid-portion 63 to sensor portion 64. As best seen in FIG. 13, formed adjoining and on either side of cam-shaped surface 72 may be chambers 71 disposed in either side 65 of indicating element 60. Chambers 71 are preferably angled or sloped as shown in FIG. 13 to facilitate indicating element 60 smoothly moving back down into the front of slot 114 of slide 22 and slot 90 in rear projection 94 of barrel unit 24 (see FIG. 7).

As best seen in FIGS. 10 and 12, indicating element 60 may further include a downwardly-projecting support portion 75 having a base 120 and vertical base walls 79 rising therefrom which intersect lower surface 73 of indicating element 60. Base 120 preferably has a flat bottom which may be circular or oval in shape, as shown. Concomitantly, base walls 79 preferably are curved to match the radius of base 120. Base 120 is preferably shaped to cooperate with base landing 111 disposed in slot 114 of slide 22 (see FIG. 5B) wherein base 120 is movably disposed when indicating element 60 is seated in slot 114. Although in the preferred embodiment support portion 75 may be disposed in the rear half 132 of indicating element 60 towards rear end 62, and preferably as close to pivot point P as possible, other suitable locations are possible. The combined height H1 (as shown in FIGS. 10 and 11) of indicating element 60 and vertical base walls 79 in one embodiment may be at least 0.2 inches high, preferably at least 0.22 inches high.

Further reference is made FIGS. 9-13, with additional reference to rear sight 38 shown in FIGS. 14-15. Indicating element 60 also includes a mounting portion 76 which preferably cooperates with rear sight 38 to pivotally mount indicating element 60 to slide 22. Mounting portion 76 includes generally horizontal upper and lower surfaces 78, 121 respectively and substantially vertical surface 77. Preferably, upper horizontal surface 78 and vertical surface 77 are substantially flat to correspond to substantially sloping front surface 146 and bottom surface 144 of rear sight 38, for reasons which will become evident below. The intersection of vertical surface 77 and upper horizontal surface 78 define a pivot point P (see FIG. 10) to pivotally mount indicating element 60. Pivot point P cooperates with leading edge 148 of rear sight 38 which defines a fulcrum for pivotally mounting indicating element 60 to slide 22. Vertical surface 77 is preferably disposed at an angle A4 to the vertical plane which is cooperatively selected with angle A5 of rear sight 38 to allow indicating element 60 to pivot upwards and rearwards when cartridge 50 contacts and displaces element 60. Preferably, angle A4 is less than angle A5 to provide a small gap G (see FIG. 4) between vertical surface 77 of indicating element mounting portion 76 and sloping front surface 146 of rear sight 38, as shown. Gap G provides clearance to allow indicating element 60 to pivot rearwards without binding. Accordingly, angle A4 preferably should not be equal to or greater than angle A5 or indicating element could not pivot to its fully-activated loaded-chamber-indication position shown in FIG. 2. Preferably, without limitation, angle A4 may typically be about 5-10 degrees less than angle A5. For example, in one embodiment, angle A4 is about 17 degrees while angle A5 is about 25 degrees. It will be appreciated that numerous combinations of angles A4 and A5 are possible so long as a sufficient gap G is provided to allow indicating element 60 to fully pivot to its fully-activated position, as described above.

In the preferred embodiment, mounting portion 76 may be located in the rear half 132 of indicating element 60. More preferably, mounting portion 76 may be located in the proximity of rear end 62 of indicating element 60 as shown to provide a long lever allowing for maximum vertical and arcuate displacement of front half 131 of indicating element 60.

Indicating element 60 is removably mounted to slide 22 by rear sight 38 in the following manner. During assembly of pistol 20, indicating element 60 is first placed in slot 114 of slide 22 in which base 120 of indicating element 60 (see FIGS. 11 and 12) is located in base landing 113 (see FIG. 5B). Rear sight 38 is mounted on horizontal landing surface 108 on top surface 110 of slide 22. In this process, upper horizontal surface 78 of indicating element mounting portion 76 becomes trapped below bottom surface 144 of rear sight 38. Indicating element 60 therefore become movably and pivotally mounted to slide 22 and cannot be removed from pistol 20 without first removing rear sight 38. This "trapped" pivotal connection is mechanically simple and reliable, and eliminates the need for a pinned connection which may malfunction and is susceptible to breakage. Manufacturing costs are also reduced by eliminating the extra parts and machining associated with a pinned connection.

A biasing member such as a helical spring 150 (see, e.g. FIGS. 2, 4, and 6) may be provided to bias indicating element 60 towards the inactivated unloaded-chamber-indication position a shown in FIG. 4. Spring 150 acts on the rear end 62 of indicating element 60, and more specifically on lower horizontal surface 121 of mounting portion 76. A vertical and upwards force is applied to lower horizontal surface 121 by spring 150 which biases the front end 61 of indicating element 60 downwards and towards contact with a cartridge 50 when loaded in chamber 48. Spring 150 rests in cylindrical spring indentation 113 (see FIG. 5B) preferably disposed at the rearmost end of slot 114 in slide 22. Preferably, the upwardly-directed spring force imparted to indicating element 60 by spring 150 acts on part of indicating element 60 to the rear of pivot point P in order to provide the concomitant downward bias of the front end 61 of indicating element 60. Although a biasing member in the form of spring 150 is disclosed, it should be noted that any suitable type of biasing member may be used so long as indicating element 60 may be biased in the foregoing described direction.

Preferably, indicating element 60 in one embodiment may be substantially rigid in structure. Indicating element 60 may made of any type steel; however, other suitable metallic (e.g., aluminum, titanium, etc.) and non-metallic materials (e.g., plastics) that are rigid may be used. In the preferred embodiment, indicating element 60 is made of stainless steel.

Indicating element 60 may include ornamental written and/or symbolic indicia "I" to identify and communicate the presence of a cartridge 50 in chamber 48 to a user of pistol 20. Indicia I may include any suitable alphanumeric characters, graphics, shapes, colors, and/or other suitable indicia or combination thereof emplaced on a signal area 134 of indicating element 60 to facilitate communicating a "loaded chamber" condition to the user. Signal area 134 has an ornamental shape and preferably includes any exposed surfaces of indicating element 60 that are visible to the user; particularly those surfaces that may protrude outwards beyond the external surfaces 100 of pistol 20 when indicating element 60 is displaced in a fully-activated loaded-chamber-indication position, as described herein. As a non-limiting example, in the embodiment shown in FIGS. 9-13, indicia I includes the word "loaded" and two geometric shapes including a circle and an elongated triangle disposed on side surfaces 65 and 67. The words "loaded chamber indicator" may be provided as shown on top surface 74 to identify the purpose of indicating element 60 to a pistol user. Indicia I may be engraved or formed into indicating element 60, surface painted thereon, or a combination thereof. Preferably, indicia I are provided in a color, such as red preferably, to enhance communication of a loaded-chamber condition. In one embodiment, at least one alphanumeric character at least 0.080 inches tall is provided.

Operation of pistol 20 and the loaded chamber indicator mechanism will now be described with reference to the preferred embodiment and FIGS. 2, 4, and 6. FIG. 2 shows pistol 20 in the ready-to-fire position with a closed breech area 152 wherein barrel unit 24 is almost flush with top surface 110 of slide 22. In a preliminary loading phase preceding the ready-to-fire position shown in FIG. 2, pistol 20 shown in FIG. 6 is in the process of being auto-loaded with a cartridge just having been received from the magazine 156. Barrel unit 24 is noticeably located below top surface 110 of slide 22 in a downward position (compare with FIG. 2). FIG. 4 shows pistol 20 in an unloaded chamber position wherein barrel unit 24 is almost flush with top surface 110 of slide 22, similar to FIG. 2.

Referring initially to FIG. 4, pistol 20 has an empty chamber 48 and indicating element 60 is in a position corresponding to a first and inactivated unloaded-chamber-indication position. In this position, indicating element 60 is preferably substantially flush or slightly recessed with respect to the top surface 110 of slide 22 such that indicating element 60 does not substantially physically protrude outwards from pistol 20. This first position signifies an unloaded chamber condition to a user of pistol 20.

The activated or loaded-chamber-indication position of indicating element 60 will now be described. It should be noted that slide 22 of pistol 20 may be retracted in either manual or automatic mode. In manual mode, the user of pistol 20 pulls back or rearwards on slide 22 to open up breech area 152 which allows a cartridge 50 to be manually loaded into chamber 48 if desired. In automatic mode, recoil forces developed by discharging pistol 20 automatically move slide 22 rearwards to open up breech area 152 and eject a spent cartridge 50. In either mode, the operation of the pistol regarding indicating element 60 is the same.

Barrel unit 24 starts in an upward and forward position as shown in either FIGS. 2 or 4 with barrel unit 24 almost flush with top surface 110 of slide 22. Either by manually pulling slide 22 rearwards, or automatically moving slide 22 rearwards by discharging pistol 20, both barrel unit 24 and slide 22 travel rearwards in unison for a distance, at least initially. The tip of downwardly-projecting cam protrusion 98 on barrel unit 24 (see FIG. 8) then engages the tip of an upwardly-projecting cam block protrusion 154 (see FIG. 2) situated below barrel unit 24. Barrel unit 24 rotates downwards with respect to slide 22 once protrusions 98, 154 become fully-engaged to the position shown in FIG. 6, as described above. In this downward and rearward position, barrel unit 24 sits noticeably lower in slide 22 than in the empty chamber position shown in FIG. 4 or the ready-to-fire position shown in FIG. 2. Slide 22 then continues it rearward movement alone, and ejector port 112 opens to either allow a new cartridge 50 to be manually loaded if slide 22 has been manually retracted, or to eject a spent cartridge casing 52 if pistol 20 has been discharged.

Reference is made to U.S. Pat. No. 5,741,996 to Ruger et al. which is incorporated herein by reference and further describes the operation of the barrel unit camming mechanism discussed above.

If slide 22 has been manually retracted, the pistol user may then load a new cartridge 50 into chamber 48. Barrel unit 24 is still in its downward and rearward position, as described above and shown in FIG. 6, when the cartridge is manually loaded. Slide 22 next begins a forward movement caused by recoil spring 158 whether in automatic mode or if slide 22 is now manually released by a pistol user after the new cartridge has been manually loaded into chamber 48. If in automatic mode, a new cartridge 50 is then picked up from magazine 156 by slide breech face 116 and moved towards and into chamber 48 by slide 22. Barrel unit 24 is still in its downward and rearward position, as described above and shown in FIG. 6, when the cartridge is automatically loaded.

After a new cartridge 50 has been manually or automatically fully loaded into chamber 48, the forward movement of slide 22 eventually closes breech area 152 with upper rear projection 94 of chamber block 46 becoming seated in breech face notch 118 of slide 22. Simultaneously, the front end 61 of indicating element 60 enters slot 90 in rear projection 94. Due to the downward and rearward position of barrel unit 24 (see FIG. 4), however, indicating element 60 may slightly contact, but is not significantly displaced upwards or fully activated by cartridge 50 which is fully-loaded into chamber 48 and situated immediately below front end 61. Slide 22 and barrel unit 24 continue their forward movement together toward the ready-to-fire position shown in FIG. 2. Downwardly-projecting cam protrusion 98 on barrel unit 24 eventually disengages from upwardly-projecting cam block protrusion 154, and barrel unit 24 is forced back upwards in relation to slide 22 being almost flush with slide top surface 110. Simultaneously, cartridge rim 56 contacts and pushes the front end 61 of indicating element 60 upwards to displace indicating element 60 to the second and fully-activated loaded-chamber-indication position, as shown in FIG. 2. Preferably, in this second position, at least part of indicating element 60 protrudes outwards from slide 22 to provide a positive visual and tactile indication of a loaded chamber condition to the pistol user. Because the pivot point P may be located near and proximate to the rear end 62 of indicating element 60 in the preferred embodiment, relatively large exposed surfaces may result on which indicia symbolizing a loaded chamber may be emplaced.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A centerfire autoloading pistol with loaded chamber indicator comprising:

a housing having an external surface and defining a chamber to receive a cartridge, the housing defining a fulcrum; and a movable indicating element having a first front end, a second rear end, and a center equally-spaced therebetween, the front end located closer to the chamber than the rear end, the indicating element pivotally engaged with the fulcrum at the rear end, the indicating element being movable from a first position in which the indicating element does not protrude outwards from the external surface of the housing to a second position in which the indicating element protrudes outwards from the external surface of the housing, the indicating element being positioned generally behind the chamber;

wherein the indicating element is positioned in the housing to contact the cartridge and is movable to a position in which the indicating element protrudes outwards from the external surface of the housing to provide a user of the pistol with a visual and tactile indication that the cartridge is loaded in the chamber;

wherein the indicating element is retained within the housing by a horizontal surface located adjacent to the second end which mates with a corresponding horizontal surface in the housing, the horizontal surface in the housing being the bottom surface of a rear sight attached to the housing.

2. The pistol of claim 1, wherein the indicating element is pivotally engaged with the fulcrum with a pinless connection.

3. The pistol of claim 1, wherein indicia are provided on a side surface of the indicating element to communicate to the user that a cartridge is loaded in the chamber, the indicia comprising at least one alphanumeric character that is at least 0.085 inches tall and visible to the user when the indicating element protrudes outwards from the external surface of the housing.

4. The pistol of claim 1, wherein the front end of the indicating element contacts the cartridge rim and has a width smaller than the width of the rear end to minimize intrusion into the housing near the chamber.

5. The pistol of claim 1, wherein the indicating element is mounted in a top of the housing.

6. The pistol of claim 1, wherein the indicating element is an elongated lever and the top of the housing comprises an elongated slat configured to pivotally receive the indicating element.

7. The pistol of claim 6, wherein the lever further comprises a support base projecting downwards from a bottom surface of the lever which rests on the housing.

8. The pistol of claim 7, wherein the elongated slot contains a landing configured to receive the support base of the lever.

9. The pistol of claim 1, wherein the indicating element comprises a forward sloping surface on the first end to make smooth initial contact with the cartridge.

* * * * *